US006776583B1

(12) United States Patent
Wang et al.

(10) Patent No.: US 6,776,583 B1
(45) Date of Patent: Aug. 17, 2004

(54) TURBINE BUCKET DAMPER PIN

(75) Inventors: John Zhiqiang Wang, Greenville, SC (US); Jon Conrad Scaeffer, Greenville, SC (US); Iain Robertson Kellock, Simpsonville, SC (US); Calvin L. Sims, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/373,757

(22) Filed: Feb. 27, 2003

(51) Int. Cl.[7] ..... F01D 5/26
(52) U.S. Cl. ..... 416/500
(58) Field of Search ..... 416/500, 220 R, 416/248; 29/889.2

(56) References Cited

U.S. PATENT DOCUMENTS

| | | | | |
|---|---|---|---|---|
| 3,266,770 A | * | 8/1966 | Harlow | 416/92 |
| 4,088,421 A | * | 5/1978 | Hoeft | 416/193 A |
| 4,389,161 A | * | 6/1983 | Brumen | 416/220 R |
| 5,685,693 A | | 11/1997 | Sexton et al. | |
| 5,779,442 A | | 7/1998 | Sexton et al. | |
| 5,823,741 A | | 10/1998 | Predmore et al. | |
| 5,906,473 A | | 5/1999 | Sexton et al. | |
| 5,913,658 A | | 6/1999 | Sexton et al. | |
| 6,079,943 A | | 6/2000 | Sexton et al. | |
| 6,082,963 A | | 7/2000 | Sexton et al. | |
| 6,390,769 B1 | | 5/2002 | Burdgick et al. | |
| 6,413,040 B1 | | 7/2002 | Yu et al. | |
| 6,422,807 B1 | | 7/2002 | Leach et al. | |
| 6,450,770 B1 | | 9/2002 | Wang et al. | |
| 6,461,110 B1 | | 10/2002 | By et al. | |
| 6,478,540 B2 | | 11/2002 | Abuaf et al. | |
| 6,481,972 B2 | | 11/2002 | Wang et al. | |
| 6,506,016 B1 | | 1/2003 | Wang | |

* cited by examiner

*Primary Examiner*—Ninh H. Nguyen
(74) *Attorney, Agent, or Firm*—Nixon & Vanderhye P.C.

(57) ABSTRACT

A damper pin for a bucket damper slot in a turbine includes slot insertion ends shaped to fit into the bucket damper slot, and at least a first scallop section formed or machined between the slot insertion ends and shaped to receive a bucket shank pocket radial contour at bucket Hi-C. A second scallop section may also be formed or machined diametrically opposed and anti-symmetrical to the first scallop section between the slot insertion ends.

17 Claims, 3 Drawing Sheets

TURBINE BUCKET DAMPER PIN

BACKGROUND OF THE INVENTION

The present invention relates to turbine bucket damper pins and, more particularly, eliminating or reducing bucket Hi-C undercut by incorporating a scallop section in a bucket damper pin.

In a turbine bucket, at a given cross-section, the point at which the gas flow reverses its direction on the convex side of the airfoil is known as the airfoil Hi-C point. Particular interest is generally of the Hi-C point at the root cross-section, known as the root section Hi-C point, since the stress at this location is generally higher than its surrounding locations. With reference to FIG. 1, for buckets with a narrow bucket-to-bucket space due to real estate constraints, the Hi-C may be located in such a way that when a bar-type damper pin slot is machined, there will be inevitable undercut 2 at the Hi-C location immediately below the platform (see the dashed line in FIG. 2). The Hi-C location is generally a highly stressed location, and an undercut 2 will further increase the stress at this location through Kt effect and the reduction of wall thickness. For example, analysis has indicated that, for a particular bucket/damper geometry, the Kt could be as high as 5.0.

It would be desirable to construct the turbine bucket damper pin to avoid the undercut while providing an easily-installed assembly geometry.

BRIEF DESCRIPTION OF THE INVENTION

In an exemplary embodiment of the invention, a damper pin is provided for a bucket damper slot in a turbine. The damper pin, includes slot insertion ends shaped to fit into the bucket damper slot; and at least a first scallop section formed or machined between the slot insertion ends and shaped to receive a bucket shank pocket radial contour at bucket Hi-C. A second scallop section may also be formed or machined diametrically opposed and anti-symmetrical to the first scallop section between the slot insertion ends.

In another exemplary embodiment of the invention, a method of constructing a damper pin for a bucket damper slot in a turbine includes the steps of (a) forming slot insertion ends shaped to fit into the bucket damper slot; and (b) machining a first scallop section between the slot insertion ends. The first scallop section is shaped to receive a bucket shank pocket radial contour at bucket Hi-C.

DETAILED DESCRIPTION OF THE INVENTION

Figure 2:
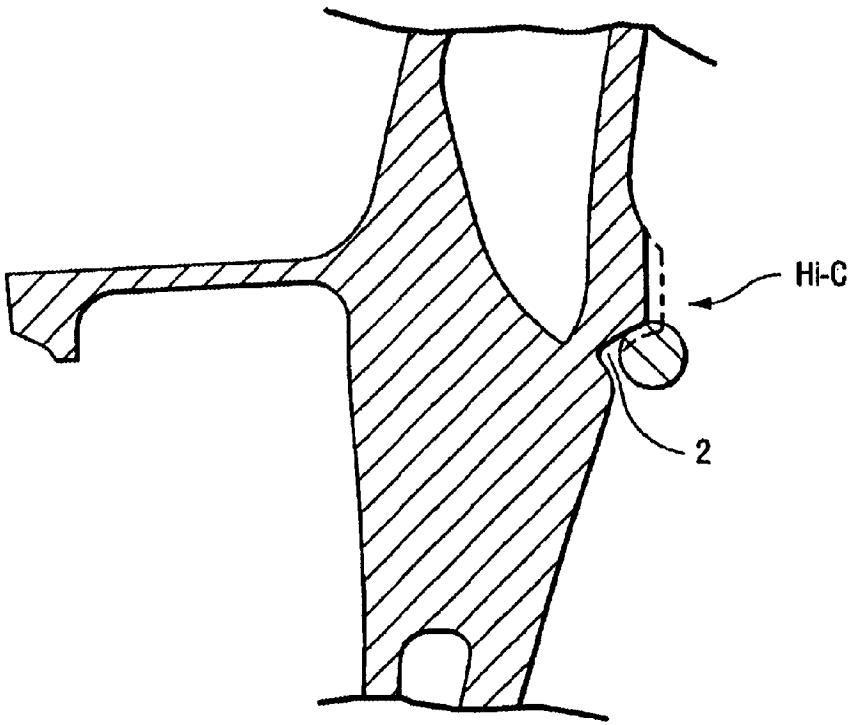
Fig. 2 (PRIOR ART)
FIG. 2 is a section view along lines 2—2 in FIG. 1.
Figure 1:
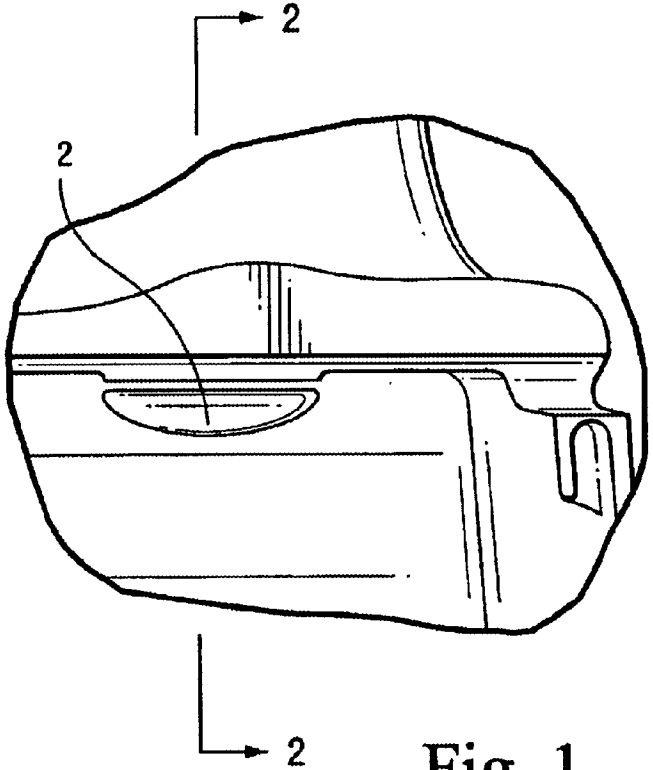
Fig. 1 (PRIOR ART)
FIG. 1 is a front view of a turbine bucket showing a Hi-C undercut.
Figure 3:
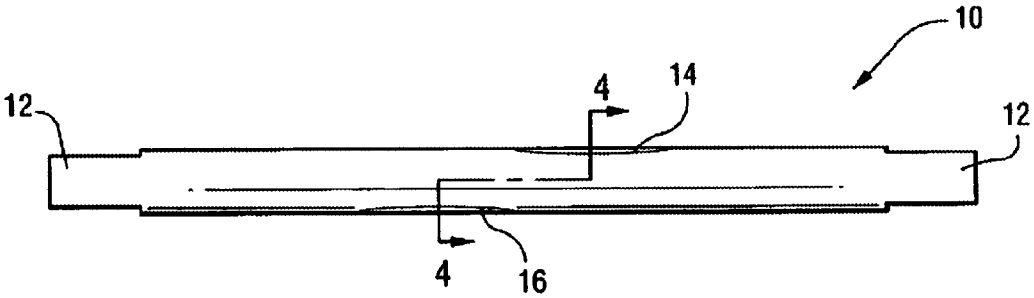
FIG. 3 is a plan view of a scalloped damper pin of the present invention.
Figure 5:
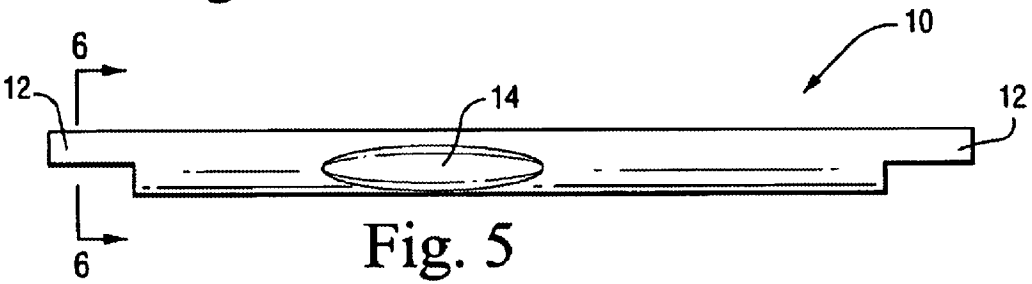
FIG. 5 is a side view of the damper pin of FIG. 3.
Figure 7:
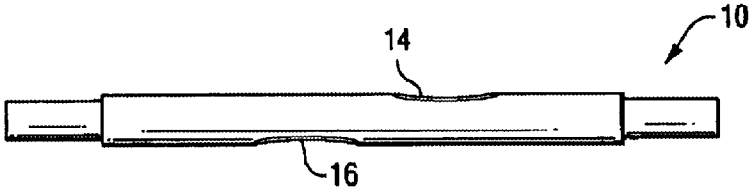
FIGS. 7 and 8 are shaded plan and side views of the scalloped damper pin.
Figure 8:
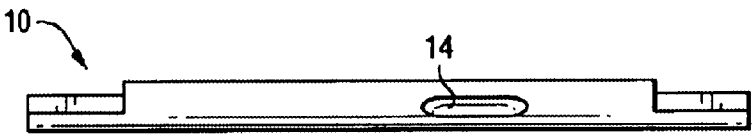

With reference to FIGS. 3–8, the damper pin 10 includes slot insertion ends 12 and at least a first scallop section 14 formed between the slot insertion ends 12. Preferably, a second scallop section 16 is formed diametrically opposed and anti-symmetrical to the first scallop section 14 between the slot insertion ends 12. As seen, for example, in FIGS. 3 and 7, by providing first 14 and second 16 scallop sections in an anti-symmetrical configuration, the damper pin 10 can be inserted in a bucket damper slot in any orientation. See also, for example, FIG. 10.

Figure 4:
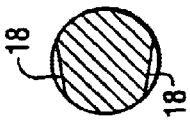
FIG. 4 is a section view along the lines 4—4 in FIG. 3.
Figure 6:
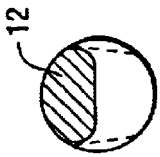
FIG. 6 is an end view along arrow 6 in FIG. 5.
Figure 9:
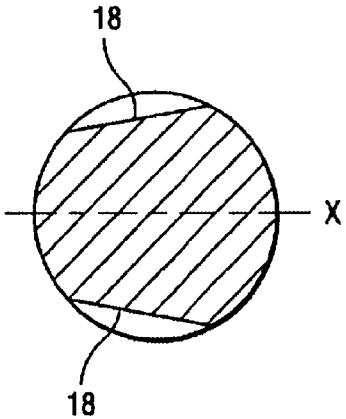
FIG. 9 is an enlarged view of the FIG. 4 section along lines 4—4 in FIG. 3.

To facilitate machining of the scallop sections 14, 16, the scallop sections 14, 16 are preferably horseshoe shaped or U-shaped at both ends transitioned into a substantially flat plane at the center. FIGS. 4 and 9 show the details of the cross section of the damper pin 10 through the scallop sections 14, 16. The trough faces 18 of the respective scallop sections 14, 16 are machined to be substantially parallel to the radial contour of the shank pocket at the Hi-C location, within manufacturing and assembly tolerances. As an example, for one particular design, the angle of the trough face of the scallop is about 12 degrees relative to the plane X shown in FIG. 9. Of course, this value is only for illustration, and the invention is not meant to be limited to the noted example.

Figure 10:
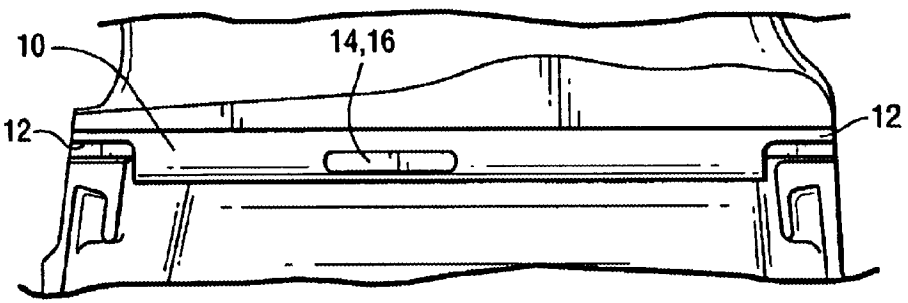
FIG. 10 illustrates the damper pin installed in the bucket damper slot.
Figure 11:
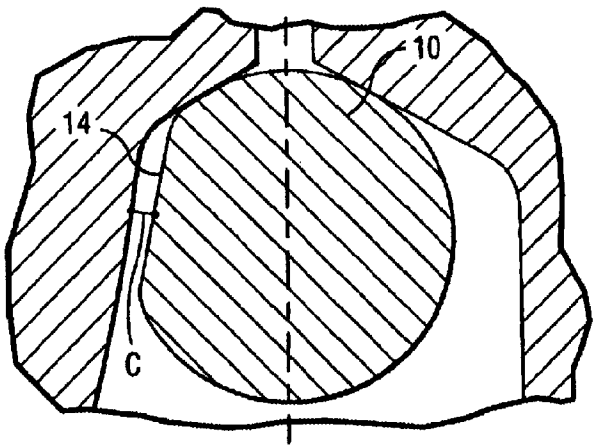
FIG. 11 is a cross section through Hi-C when the damper is at its operating condition.

FIGS. 10 and 11 illustrate the damper pin 10 installed in a bucket damper slot. At the assembled condition, a radial clearance c of the damper 10 within the bucket shank should be such that it will not create hot binding considering manufacturing and assembly tolerances and hot growths. The bucket damper slot is created when two adjacent buckets are assembled into the wheel. The insertion ends 12 of the damper pin 10 are supported in the bucket damper slot. Preferably, the shape of the damper ends 12 and the slot are designed such that both sealing and frictional damping are ensured during operation.

With the scalloped bucket damper pin of the present invention, undercut at airfoil root Hi-C of a turbine bucket can be avoided. Consequently, Kt stresses due to a Hi-C undercut at the critical stress location can be avoided. Additionally, by incorporating a second scallop section, damper placement at bucket assembly in the wheel can be facilitated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A damper pin for a bucket damper slot in a turbine, the damper pin comprising:

slot insertion ends shaped to fit into the bucket damper slot; and a first scallop section formed between the slot insertion ends and shaped to receive a bucket shank pocket radial contour at bucket Hi-C.

2. A damper pin according to claim 1, further comprising a second scallop section formed diametrically opposed and anti-symmetrical to the first scallop section between the slot insertion ends, the second scallop section being shaped to receive the bucket shank pocket radial contour at bucket HI-C.

3. A damper pin according to claim 2, wherein the first and second scallop sections are substantially U-shaped.

4. A damper pin according to claim 3, wherein a center of the first scallop section and a center of the second scallop section are substantially flat planes.

5. A damper pin according to claim 4, wherein a trough face of the first scallop section and a trough face of the second scallop section are substantially parallel to the bucket shank pocket radial contour within manufacturing and assembly tolerances.

6. A damper pin according to claim 1, wherein the first scallop section is substantially U-shaped.

7. A damper pin according to claim 6, wherein a center of the first scallop section is a substantially flat plane.

8. A damper pin according to claim 7, wherein a trough face of the first scallop section is substantially parallel to the bucket shank pocket radial contour within manufacturing and assembly tolerances.

9. A method of constructing a damper pin for a bucket damper slot in a turbine, the method comprising:

(a) forming slot insertion ends shaped to fit into the bucket damper slot; and (b) machining a first scallop section between the slot insertion ends, the first scallop section being shaped to receive a bucket shank pocket radial contour at bucket Hi-C.

10. A method according to claim 9, further comprising (c) machining a second scallop section diametrically opposed and anti-symmetrical to the first scallop section between the slot insertion ends, the second scallop section being shaped to receive the bucket shank pocket radial contour at bucket HI-C.

11. A method according to claim 10, wherein steps (b) and (c) are practiced by machining the first and second scallop sections to be substantially U-shaped.

12. A method according to claim 11, wherein steps (b) and (c) are practiced by machining a center of the first scallop section and a center of the second scallop section to be substantially flat planes.

13. A method according to claim 12, wherein steps (b) and (c) are practiced by machining a trough face of the first scallop section and a trough face of the second scallop section to be substantially parallel to the bucket shank pocket radial contour within manufacturing and assembly tolerances.

14. A method according to claim 9, wherein step (b) is practiced by machining the first scallop section to be substantially U-shaped.

15. A method according to claim 14, wherein step (b) is practiced by machining a center of the first scallop section to be a substantially flat plane.

16. A method according to claim 15, wherein step (b) is practiced by machining a trough face of the first scallop section to be substantially parallel to the bucket shank pocket radial contour within manufacturing and assembly tolerances.

17. A damper pin for a bucket damper slot in a turbine, the damper pin comprising:

slot insertion ends shaped to fit into the bucket damper slot;

a first scallop section machined between the slot insertion ends; and a second scallop section machined diametrically opposed and anti-symmetrical to the first scallop section between the slot insertion ends, the first and second scallop sections being shaped to receive the bucket shank pocket radial contour at bucket HI-C.

* * * * *

UNITED STATES PATENT AND TRADEMARK OFFICE

CERTIFICATE OF CORRECTION

PATENT NO. : 6,776,583 B1
DATED : August 17, 2004
INVENTOR(S) : Wang et al.

It is certified that error appears in the above-identified patent and that said Letters Patent is hereby corrected as shown below:

Title page,
Item [75], Inventors, delete "(75) Inventors: John Zhiqiang Wang, Greenville, SC (US); Jon Conrad Scaeffer, Greenville, SC (US); Iain Robertson Kellock, Simpsonville, SC (US); Calvin L. Sims, Mauldin, SC (US)" and insert therefor -- (75) Inventors: John Zhiqiang Wang, Greenville, SC (US); Jon Conrad Schaeffer, Greenville, SC (US); Iain Robertson Kellock, Simpsonville, SC (US); Calvin L. Sims, Mauldin, SC (US) --.

Column 1,
Line 34, delete "pin," and insert -- pin --.

Signed and Sealed this

Twelfth Day of October, 2004

JON W. DUDAS
*Director of the United States Patent and Trademark Office*